US006533609B2

(12) United States Patent
Koide

(10) Patent No.: US 6,533,609 B2
(45) Date of Patent: Mar. 18, 2003

(54) SHIELDING TERMINAL AND A MOUNTING METHOD THEREFOR

(75) Inventor: Takashi Koide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/910,188

(22) Filed: Jul. 20, 2001

(65) Prior Publication Data

US 2002/0016105 A1 Feb. 7, 2002

(30) Foreign Application Priority Data

Jul. 21, 2000 (JP) ..... 2000-220711

(51) Int. Cl.[7] ..... H01R 9/05; H01R 13/648; H01R 4/66; H01R 9/03

(52) U.S. Cl. ..... 439/578; 439/98; 439/610; 439/585

(58) Field of Search ..... 439/578, 98, 585, 439/610

(56) References Cited

U.S. PATENT DOCUMENTS

| | | | | |
|---|---|---|---|---|
| 4,857,014 A | * | 8/1989 | Alf et al. | 439/578 |
| 5,205,761 A | * | 4/1993 | Nilsson | 439/394 |
| 5,624,278 A | | 4/1997 | Kuroda et al. | |
| 5,931,698 A | * | 8/1999 | Kodama | 439/578 |
| 5,975,950 A | | 11/1999 | Yamaguchi | |
| 6,065,998 A | * | 5/2000 | Peloza | 439/108 |
| 6,083,014 A | * | 7/2000 | Bogdan et al. | 439/610 |
| 6,200,162 B1 | * | 3/2001 | Aoyama et al. | 439/578 |
| 6,217,381 B1 | * | 4/2001 | Kameyama | 439/578 |
| 6,231,387 B1 | * | 5/2001 | Kameyama | 439/394 |
| 6,257,912 B1 | * | 7/2001 | Boillot et al. | 439/329 |
| 6,305,977 B1 | * | 10/2001 | Ozaki | 439/578 |
| 6,336,827 B1 | * | 1/2002 | Akama et al. | 174/261 |

FOREIGN PATENT DOCUMENTS

| | | |
|---|---|---|
| EP | 0 981 180 A1 | 8/2000 |
| JP | 5-27983 | 4/1993 |

* cited by examiner

*Primary Examiner*—Tho D. Ta
*Assistant Examiner*—Edwin A. León
(74) *Attorney, Agent, or Firm*—Anthony J. Casella; Gerald E. Hespos

(57) ABSTRACT

A shielding terminal has a lock (14) mounted in an area extending from an opening (22) of a covering wall (21) to an outer crimping portion (23) of an outer terminal (12), and is fixed with respect to the outer terminal (12) by mounting plates (41) wrapping around the outer crimping portion (23). At this stage, a locking edge (45) at the leading end of the lock (14) faces a bottom end of the rear end of a connecting portion (15) of an inner terminal (11) so as to be engageable therewith for locking. Accordingly, even if the inner terminal (11) tries to come out of a dielectric element (13) upon action of a pulling force on a core (2) of a shielded cable (1), the rear end of the connecting portion (15) comes into contact with the locking edge (45) of the lock (14) to prevent such a movement.

9 Claims, 6 Drawing Sheets

SHIELDING TERMINAL AND A MOUNTING METHOD THEREFOR

BACKGROUND OF THE INVENTION

1. Field of the Invention

The present invention relates to a shielding terminal to be connected with an end of a shielded cable and to a method for mounting a shielding terminal to an end of a shielded cable.

2. Description of the Related Art

A known shielding terminal is illustrated in FIGS. 8 and 9 and has an inner terminal "a" for connection with a mating terminal, an outer terminal "c" that accommodates the inner terminal "a" and a dielectric element "b" provided between the inner and outer terminals "a" and "c". The inner terminal "a" is crimped into connection with an end of a core "e" of a shielded cable "d", and the outer terminal "c" is crimped into connection with ends of a braided wire "f" and a sheath "g".

A shielding terminal of the type shown in FIGS. 8 and 9 must have a large fastening force to the shielded cable "d" to prevent the shielded cable "d" from being detached from the shielding terminal in response to a pulling force on the shielded cable "d". Conventionally, biting blades have been formed to project from the outer surface of the inner terminal "a". The biting blades bite in the inner surface of the dielectric element "b" to prevent the shielded cable "d" from being detached from the shielding terminal.

The conventional shielding terminal has a groove formed behind the biting blades in the inner surface of the dielectric element. Thus, sufficient force to prevent the detachment may not be obtained due to a possible insufficient degree of engagement. Accordingly, there is a demand for a further improvement.

The present invention was developed in view of the above situation and an object thereof is to provide a shielding terminal and a mounting method that achieve a larger fastening force of the shielding terminal to a shielded cable.

SUMMARY OF THE INVENTION

The invention is directed to a shielding terminal that can be connected with an end of a shielded cable. The shielding terminal comprises an inner terminal for connection with a core of the shielded cable and an outer terminal for connection with a shield layer of the shielded cable. The outer terminal at least partly accommodates the inner terminal with a dielectric element provided between the inner and outer terminals. The shielding terminal further comprises a lock mountable in or on the outer terminal for preventing the inner terminal from coming out.

A force may act to move the inner terminal out of the dielectric element, such as when the core is pulled. However, the inner terminal is locked in the outer terminal by the lock and is prevented from coming out of the dielectric element. Therefore, a fastening force to the shielded cable can be strengthened.

A preferred embodiment of the shielding terminal is constructed for connection with an end of a shielded cable that comprises a core, an insulating layer surrounding the core, a braided wire surrounding the insulating layer and a sheath on the outer surface of the braided wire. The shielding terminal comprises an inner terminal to be connected with the core and an outer terminal to be connected with the braided wire. The outer terminal accommodates the inner terminal and a dielectric element that is provided between the inner and outer terminals. A lock is mounted in the outer terminal to prevent the inner terminal from coming out of the outer terminal. More particularly, an opening may be formed in part of a circumferential surface of the outer terminal, and the lock may be mounted at least partly in the opening. The lock mounted in the opening in the circumferential surface of the outer terminal prevents the shielding terminal from becoming larger.

A shield plate may be mounted on or provided in the lock. The shield plate preferably is connectable with the shield layer and/or the outer terminal. A shielding performance can be improved by providing the shield plate in the opening where no shield member has been present.

The lock preferably is formed with a locking edge that can be locked with a rear portion of the inner terminal, and preferably with a connection portion of the inner terminal.

The lock preferably comprises latching means for latching the lock with the inner and/or outer terminals. The latching means may comprise hooks that engage at least one crimping portion of the outer terminal.

The lock may comprise locking means for engagement with a sheath of the shielded cable and/or with the dielectric member.

The invention also is directed to a method for mounting, assembling or connecting a shielding terminal with an end of a shield cable. The method comprises connecting an inner terminal with a core of the shielded cable. The method then comprises connecting an outer terminal with a shield layer of the shielded cable and at least partly accommodating the inner terminal with a dielectric element provided between the inner and outer terminals. The method then includes mounting a lock in or on the outer terminal for preventing the inner terminal from coming out.

The lock preferably is mounted in an opening formed in part of a circumferential surface of the outer terminal.

Preferably, a shield plate is mounted on or in the lock. The shield plate preferably is connected with the shield layer and/or the outer terminal.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
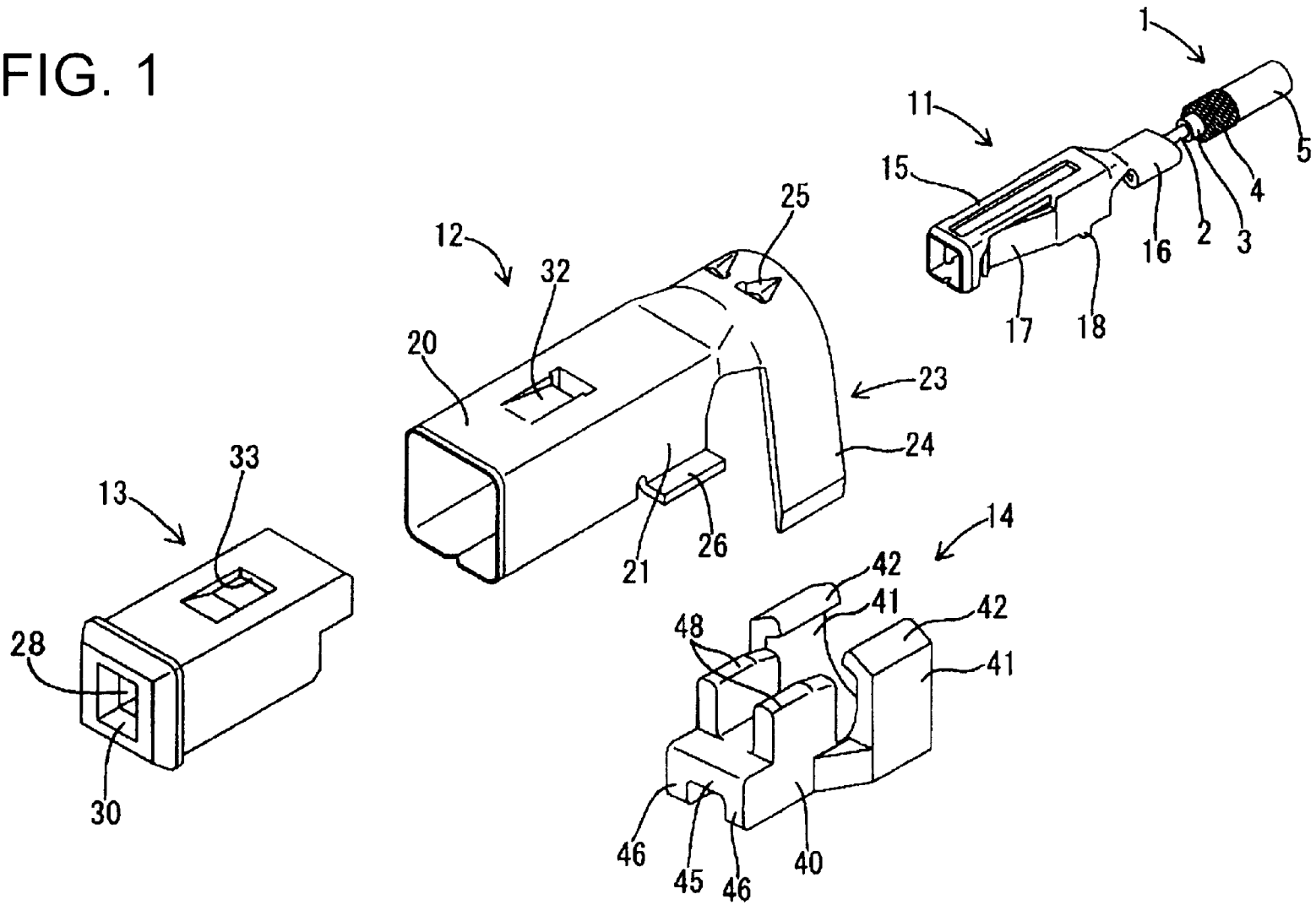
FIG. 1 is an exploded perspective view of one embodiment of the present invention.
Figure 2:
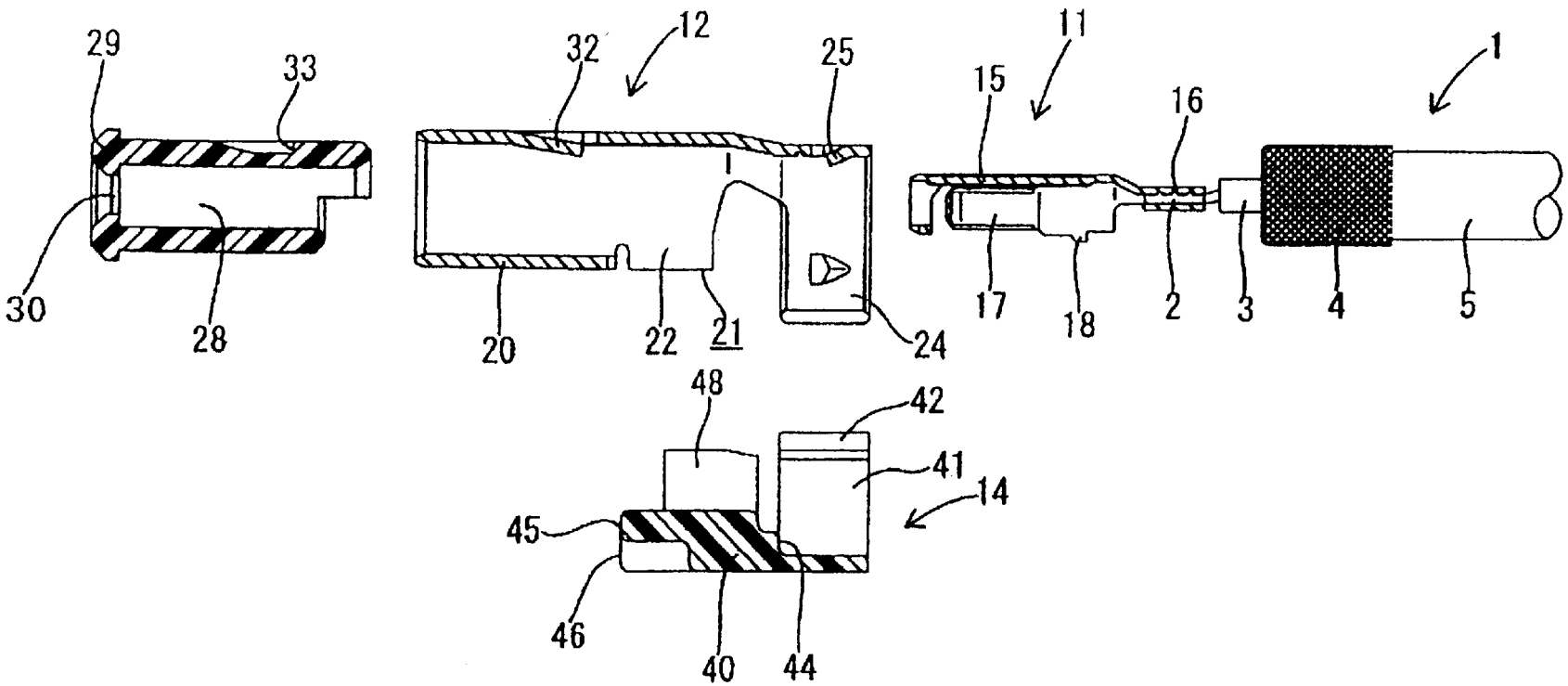
FIG. 2 is an exploded side view partly in section of this embodiment.
Figure 3:
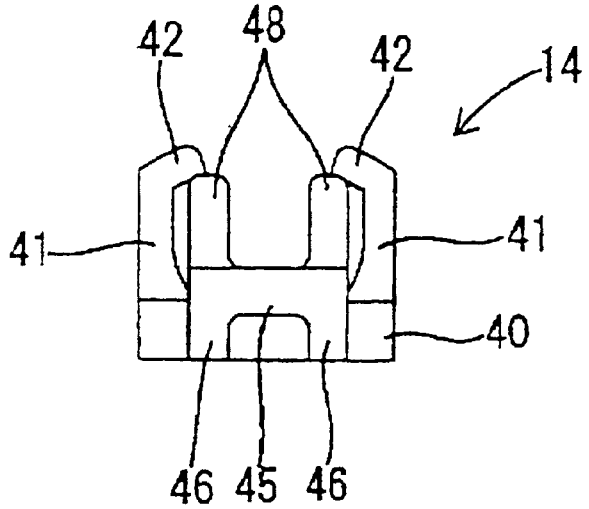
FIG. 3 is a front view of a lock member.

A female shielding terminal in accordance with the invention is identified by the numeral 10 in FIGS. 1–7. The female shielding terminal 10 can be crimped, folded or bent into connection with an end of a shielded cable 1. The shielded cable 1 has a known structure with a core 2 formed by bundling a plurality of strands. An insulating layer 3 surrounds the core 2, and a shield layer, such as a braided wire 4 or a shield film surrounds the insulating layer 3. A sheath 5 made of a rubber or the like surrounds the braided wire 4, as shown in FIGS. 1 and 2. An end of the shielded cable 1 is processed by stripping off an end of the sheath 5. The exposed section of the braided wire 4 then is folded back on the sheath 5, and an exposed end of the insulating layer 3 is cut off to expose the core 2.

The shielding terminal 10 is comprised of an inner terminal 11, an outer terminal 12, a dielectric element 13 and a locking member 14, as shown in FIGS. 1 and 2.

The inner terminal 11 is formed by bending a metallic plate, and includes opposite front and rear ends. A substantially rectangular tubular female connecting portion 15 is formed at the front end, and transversely arranged inner crimping pieces 16 are formed behind the connecting portion 15 for crimped connection with the core 2 of the shielded cable 1. Contact pieces 17 are formed at opposite side surfaces of the connecting portion 15, and are configured for connection with a tab (not shown) of a mating male inner terminal. The contact pieces 17 cantilever forward and are bent so that facing surfaces at the leading ends of the contact pieces 17 bulge inwardly. The contact pieces 17 are resiliently or elastically deformable in directions that cause their leading ends to move toward and away from each other as the tab of the mating terminal is insertable therebetween.

The bottom wall of the rear end of the connecting portion 15 is cut off, and one or more biting blades 18 are formed at the bottom edges of the left and right side walls near the rear end. The biting blades 18 bite in the bottom wall of the dielectric element 13 when the connecting portion 15 is pressed into the dielectric element.

The outer terminal 12 also is formed by bending a metallic plate and has opposite front and rear ends. A large substantially rectangular tubular accommodating portion 20 is formed at the front end of the outer terminal 12, and a covering wall 21 is formed rearward of the accommodating portion 20. The covering wall 21 is closed on three sides, but has an open bottom. An outer crimping portion 23 is formed to the rear of the covering wall 21 and can be crimped, folded or bent into connection with a folded section of the braided wire 4 of the shielded cable 1. The outer crimping portion 23 has two transversely arranged outer crimping pieces 24 that are wound or folded at least partly around the folded section of the braided wire 4 such that an end of one crimping piece 24 is placed substantially over the end of the other. The crimped outer crimping portions 23 have an arcuate upper surface with a small curvature, a substantially semicircular bottom surface, and substantially parallel left and right surfaces.

Wedge-shaped projections 25 are formed at the base ends of the two outer crimping pieces 24 and on the outer crimping piece 24 which is placed more inside the other in its wound state. Further, stabilizers 26 project laterally outward from the bottom edges of the left and right side walls of the covering wall 21.

The dielectric element 13 is made of an insulating material, such as a synthetic resin, and electrically insulates the inner and outer terminals 11, 12 from each other. The dielectric element 13 has a shape that conforms to the inner and outer terminals 11, 12 and preferably is in the form of a substantially rectangular tube with a thick wall that can be fit into the front end of the accommodating portion 20 of the outer terminal 12. An accommodating hole 28 is defined inside the dielectric element 13, and is dimensioned to accommodate the connecting portion 15 of the inner terminal 11. A flange 29 is formed at the front surface of the dielectric element 13 and can be brought into abutment against the front edge of the accommodating portion 20 of the outer terminal 12. A terminal insertion opening 30 is defined at the front end of the accommodating hole 28 for receiving the tab of the mating terminal. Further, the lower half of the rear end of the dielectric element 13 is cut off to conform to the configuration of the accommodating portion 20 of the outer terminal 12.

A metal lock 32 is formed by cutting the upper surface of the accommodating portion 20 of the outer terminal 12 and bending the cut portion inward and obliquely backward. Additionally, a lock hole 33 is formed in the upper surface of the dielectric element 13 for receiving the metal lock 32 of the outer terminal 12.

The lock 14 is made e.g. of a synthetic resin and is mounted in an area that extends substantially from an opening 22 of the covering wall 21 of the outer terminal 12 to the outer crimping portion 23. The lock 14 includes a narrow base plate 40 and has a front portion that is sufficiently narrow to be fit closely into the opening 22 of the covering wall 21 (see FIG. 7). Two mounting plates 41 project substantially normal to the opposite side edges of the rear end of the base plate 40. The mounting plates 41 are formed to surround the crimped outer crimping portion 23 from its bottom surface to its left and right side surfaces. Hooks 42 extend inward at the upper ends of the mounting plates 41 and engage the left and right corners of the upper surface of the crimped outer crimping portion 23. The mounting plates 41 are resiliently or elastically deformable such that their upper ends move toward and away from each other.

The base plate 40 is thicker at the front end than at the rear end, and a locking step 44 is defined at the rear of the upper surface of the front end. The locking step 44 engages the end of the sheath 5 of the shielded cable 1 that is covered by the folded section of the braided wire 4 and engages the front part of the crimped outer crimping portion 23.

Figure 5:
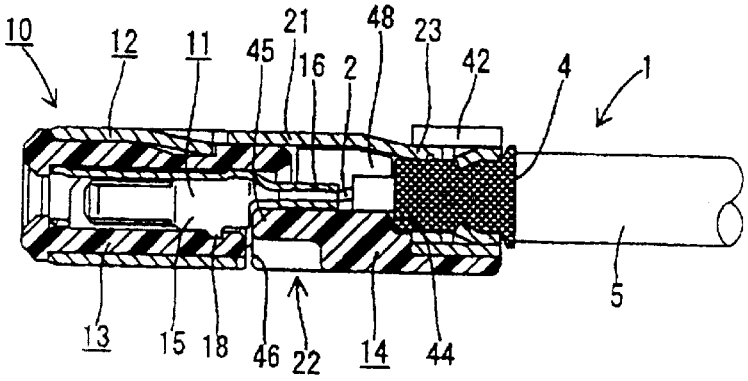
FIG. 5 is a vertical section showing an assembled state of a shielding terminal and a shielded cable.

A front half of the front end of the base plate 40 is thinned in the widthwise center of its lower surface to form a gate. The upper edge of the front surface of this gate defines a locking edge 45 that is engageable with the bottom of the rear end of the connecting portion 15 of the inner terminal 11. Further, left and right side edges 46 of the front surface of the gate engage edges left by cutting off the portions of the dielectric element 13 and the accommodating portion 20 of the outer terminal 12, as shown in FIG. 5.

Left and right side walls 48 stand from the left and right side edges of the front end of the base plate 40, and a portion of an assembly of the inner terminal 11 and the shielded cable 1 from the end of the insulating layer 3 to the inner crimping pieces 16 can be accommodated between the side walls 48.

Figure 4:
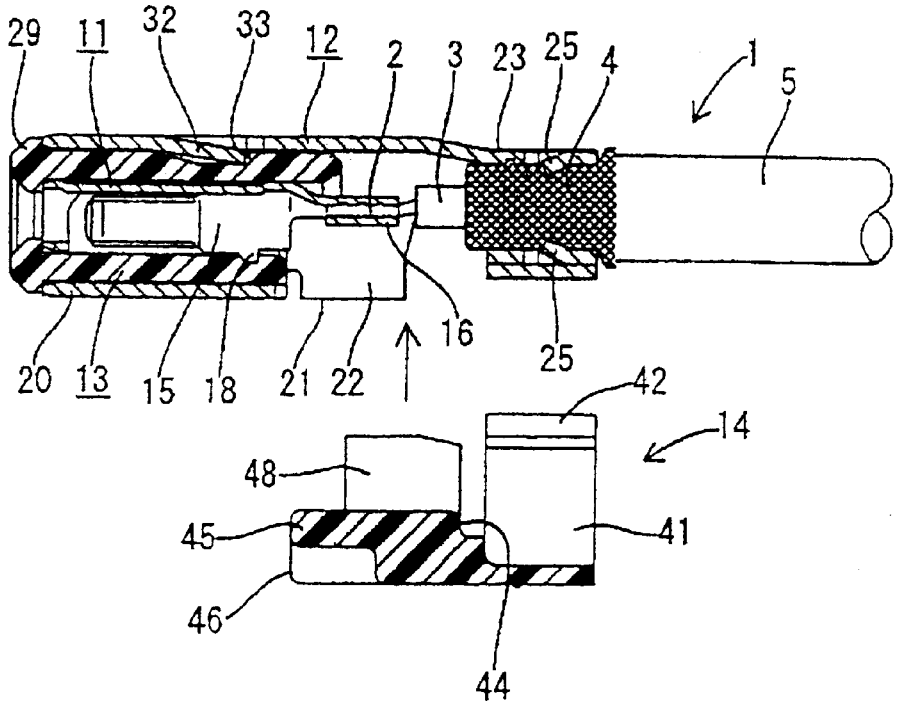
FIG. 4 is a vertical section showing a mounting operation of the locking member.

The end of the shielded cable 1 is processed as described above, and the inner crimping pieces 16 of the inner terminal 11 are crimped, folded or bent into connection with the end of the core 2. The dielectric element 13 then is inserted into the accommodating portion 20 of the outer terminal 12 from the front. The insertion of the dielectric element 13 deforms the metal lock 32. However, the metal lock 32 is restored resiliently toward its original shape to fit into the locking hole 33 when the flange 29 contacts the front edge of the accommodating portion 20, as shown in FIG. 4. As a result, the dielectric element 13 is fixed at the front end of the accommodating portion 20.

Subsequently, the inner terminal 11 is inserted into the accommodating portion 20 of the outer terminal 12 from behind, and is pushed into the accommodating hole 28 of the dielectric element 13 that is fixed in the accommodating portion 20. More particularly, the inner terminal 11 is pushed by a jig inserted through the opening 22 of the covering wall 21. At this stage, the biting blades 18 press against and bite into the bottom wall of the accommodating hole 28. As a result, the inner terminal 11 is partly locked.

The outer crimping pieces 24 of the outer terminal 12 then are crimped and wound at least partly around the folded section of the braided wire 4 for fastened to the folded section of the braided wire 4 and the end of the sheath 5. At this time, the projections 25 bite into the braided wire 4 to achieve a stronger fastening of the outer crimping pieces 24.

Figure 6:
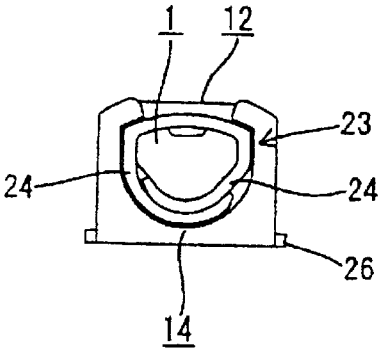
FIG. 6 is a rear view showing the assembled state.
Figure 7:
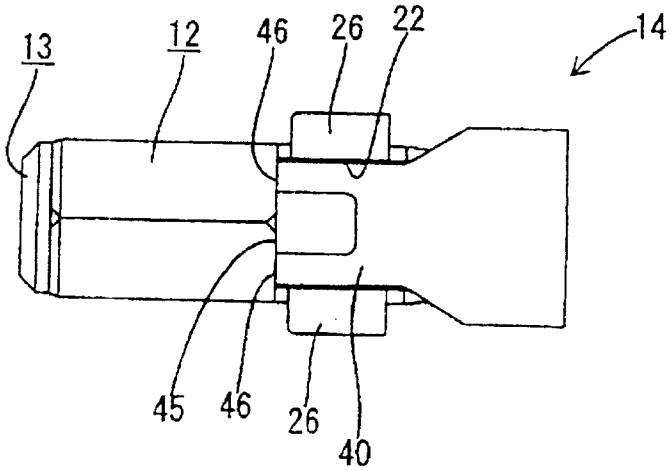
FIG. 7 is a bottom view showing the assembled state.
Figure 8:
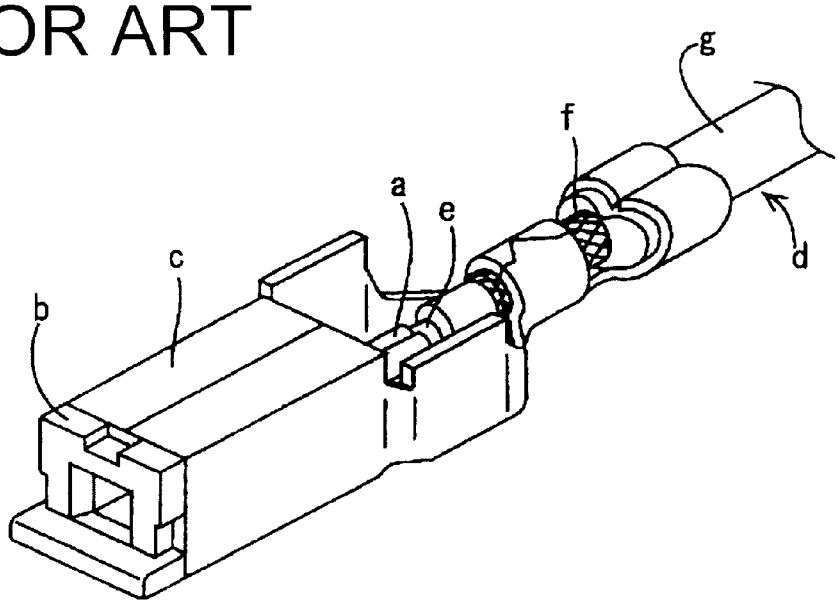
FIG. 8 PRIOR ART
FIGS. 8 and 9 are a perspective view and a plan view of a prior art shielding terminal connected with a shielded cable.
Figure 9:
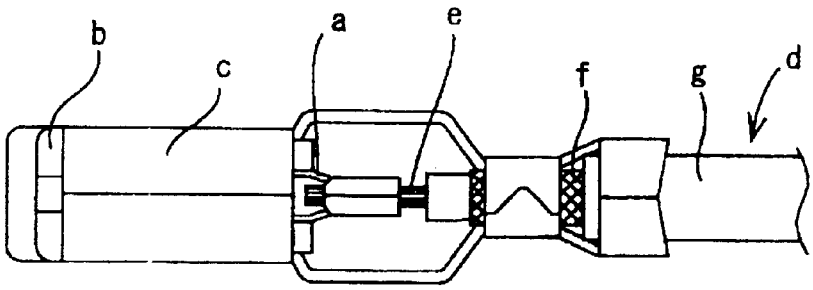
FIG. 9 PRIOR ART

Finally, as indicated by the arrow in FIG. 4, the lock 14 is mounted in the area extending from the opening 22 of the covering wall 21 of the outer terminal 12 to the outer crimping portion 23. More particularly, the opposite side walls 48 on the base plate 40 are inserted into the opening 22 of the covering wall 21. Simultaneously, the opposite mounting plates 41 move along the crimped outer crimping portion 23 and widen the spacing between the opposed mounting plates 41. When the side walls 48 are inserted sufficiently to contact the ceiling surface of the accommodating portion 20 of the outer terminal 12, the hooks 42 of the mounting plates 41 pass the corners of the upper surface of the outer crimping portion 23. Thus, the hooks 42 engage the corners of the upper surface of the outer crimping portion 23 and the mounting plates 41 are restored as shown in FIG. 6. Preferably simultaneously, the locking step 44 engages the end of the sheath 5 and the front part of the outer crimping portion 23; the rear edges of the side walls 48 engage the front end of the sheath 5; the left and right side edges 46 at the front surface of the gate engage the cut-off portions of the dielectric element 13 and the outer terminal 12 from behind; and the front ends of the side walls 48 engaged the rear end of the upper part of the dielectric element 13.

In this way, the lock 14 is fixed in the outer terminal 12 and will not move downward, forward or backward. Additionally, the lock 14 covers the opening 22 of the covering wall portion 21 of the outer terminal 12 and the outer crimping portion 23.

At this time, the locking edge 45 at the leading end of the lock 14 faces and lockingly engages the bottom end of the rear end of the connecting portion 15 of the inner terminal 11. Thus, a pulling force on the core 2 of the shielded cable 1 is resisted by the engagement of the rear end of the connecting portion 15 with the locking edge 45 of the lock 14 to prevent the inner terminal 11 from coming out of the dielectric element 13.

As described above, a "double-locking construction" is realized by providing the lock 14 for locking the inner terminal 11 in the outer terminal 12. This effectively prevents the inner terminal 11 from coming out of the dielectric element 13 and strengthens a fastening force to the shielded cable 1.

Figure 3A:
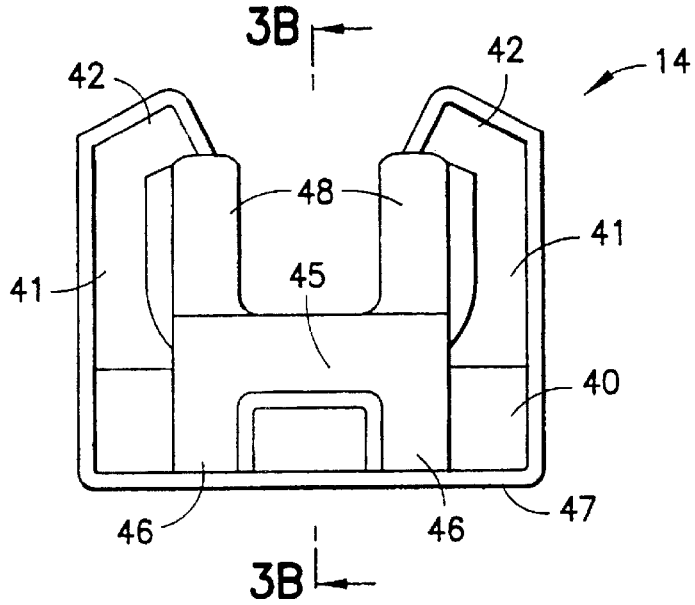
FIG. 3A is front view of an alternative to the lock shown in FIG. 3.
Figure 3B:
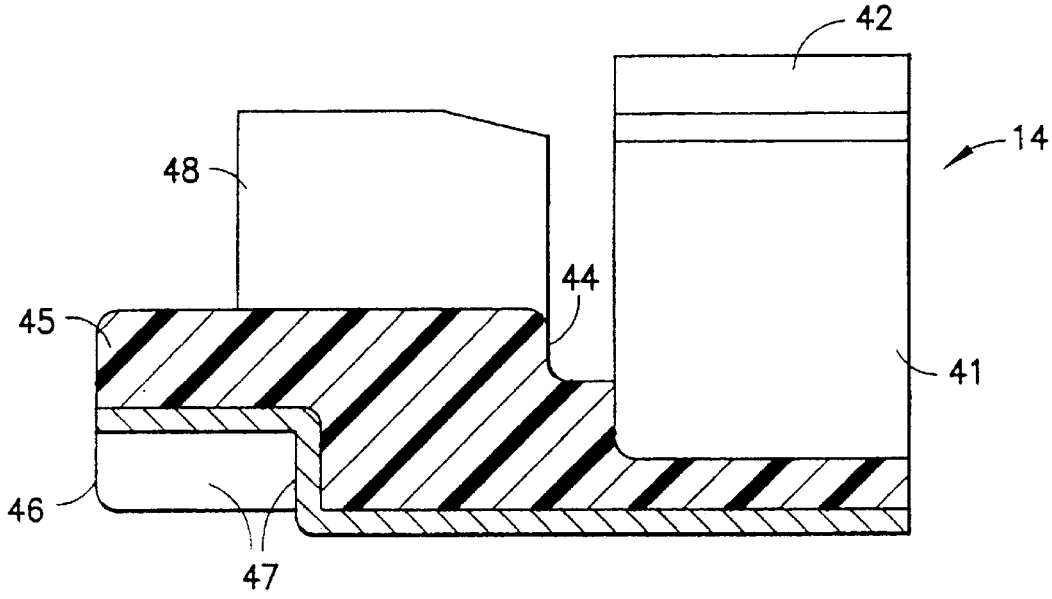
FIG. 3B is a cross sectional view taken a long line 3B–3B in FIG. 3A.

Further, the lock 14 is mounted mainly by being fitted in the opening 22 of the covering wall 21. Thus, the lock 14 prevents the entire shielding terminal 10 from becoming larger despite the provision of the lock 14, as shown in FIGS. 3A and 3B.

The shielding performance of the terminal 10 can be improved by incorporating at least one shield into the lock 14. The shield may be disposed at portions of the lock 14 that will engage the shield layer 4 of the shielded cable 1 and/or the outer terminal 12. For example, a metal coating 47 can be applied to lower surface regions of the base plate 40, outer surface regions of the mounting plates 41 and upper and outer surface regions of the hooks 42. Thus, a continuous shielding will extend across the open bottom of the covering wall 21 and substantially continuously between the accommodating portion 20 and the crimping pieces 24. Alternatively, a separate metal plate (not shown) can be insert molded into the lower portions of the lock 14 for extending across the open bottom of the covering wall 21.

The present invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

If a metallic plate is mounted as a shield plate in the locking member and part thereof is electrically connected with the outer terminal or another shield wall, the shield plate can also be provided at the opening of the covering wall portion where no shield member has been present. As a result, shielding performance can be improved.

Although the female shielding terminal is illustrated in the foregoing embodiment, the present invention is similarly applicable to male shielding terminals.

What is claimed is:

1. A shielding terminal for connection with an end of a shielded cable, the shielded cable having a core and a shield layer surrounding and spaced from the core, the shielding terminal comprising:

an inner terminal for connection with the core of the shielded cable;

a dielectric element surrounding the inner terminal;

an outer terminal for connection with the shield layer of the shielded cable while accommodating at least parts of the inner terminal and the dielectric element; and a lock mounted to the outer terminal for locking the inner terminal in the dielectric element and in the outer terminal, wherein a shield plate is mounted on the lock, the shield plate being connectable with the shield layer and the outer terminal.

2. A shielding terminal according to claim 1, wherein an opening is formed in part of a circumferential surface of the outer terminal, the locking member being at least partly mountable in the opening.

3. A shielding terminal according to claim 1, wherein the lock is formed with a locking edge engaged with a rear portion of the inner terminal.

4. A shielding terminal according to claim 1, wherein the shielded cable has a sheath, and wherein the lock comprises a locking means for engaging the sheath of the shielded cable and the dielectric member.

5. A shielding terminal for connection with an end of a shielded cable, the shielded cable having a core and a shield layer surrounding and spaced from the core, the shielding terminal comprising:

an inner terminal for connection with the core of the shielded cable;

a dielectric element surrounding the inner terminal;

an outer terminal for connection with the shield layer of the shielded cable while accommodating at least parts of the inner terminal and the dielectric element; and a lock mounted to the outer terminal for locking the inner terminal in the dielectric element and in the outer terminal, wherein the lock comprises latching means for latching the lock with at least one of the inner and outer terminals, and wherein the latching means comprise hooks engageable with at least one crimping portion of the outer terminal.

6. A method of mounting a shielding terminal with an end of a shielded cable, the shielded cable having a core and a shield layer surrounding and spaced from the core, the method comprising:

inserting a dielectric element into an outer terminal;

connecting an inner terminal with the core of the shielded cable;

inserting the inner terminal into the dielectric element, such that the dielectric element is between the inner and outer terminals;

connecting the outer terminal with the shield layer of the shielded cable;

mounting a lock in an opening formed in part of a circumferential surface of the outer terminal for locking the inner terminal so as not to come out, wherein a shield plate is mounted on the lock; and connecting the shield plate with the shield layer and the outer terminal.

7. A shielding terminal for connection with an end of a shielded cable, the shielded cable having a core and a shield layer surrounding and spaced from the core, the shielding terminal comprising:

an inner terminal having a connection portion for mating with another terminal and a crimping portion for crimped connection with the core of the shielded cable;

a dielectric element surrounding the connection portion of the inner terminal;

an outer terminal having opposite front and rear ends, an accommodating portion extending rearward from the front end and surrounding the dielectric element, a covering portion extending rearward from the accommodating portion and being open on one side, and an outer crimping portion for crimped connection with the shield layer of the shielded cable; and a lock mounted in the open side of the covering portion of the outer terminal and engaging a rear end of the connection portion for locking the inner terminal in the dielectric element and in the outer terminal, wherein a shield plate is mounted on the lock, the shield plate being connectable with the shield layer and the outer terminal.

8. A shielding terminal according to claim 7, wherein the lock comprises hooks engaged with at least one outer crimping portion of the outer terminal.

9. A shielding terminal according to claim 8, wherein the shielded cable has a sheath, and wherein the lock comprises a locking means for engaging the sheath of the shielded cable.

* * * * *